US005184913A

United States Patent [19]

Meriwether

[11] Patent Number: 5,184,913

[45] Date of Patent: Feb. 9, 1993

[54] WATERCRAFT LAUNCHING AND LIFT ASSEMBLY AND KIT THEREFOR

[75] Inventor: Jon D. Meriwether, Follansbee, W. Va.

[73] Assignee: The Louis Berkman Company, Steubenville, Ohio

[21] Appl. No.: 829,323

[22] Filed: Feb. 3, 1992

[51] Int. Cl.[5] ..... B63C 3/00

[52] U.S. Cl. ..... 405/1; 114/48; 414/477; 280/414.1; 405/3

[58] Field of Search ..... 405/1, 3, 209, 206, 405/207; 114/44-48; 280/414.1; 414/476, 477, 480

[56] References Cited

U.S. PATENT DOCUMENTS

| | | | |
|---|---|---|---|
| 2,485,793 | 10/1949 | Vassar | 414/477 |
| 2,809,496 | 10/1957 | Geil | 280/414.1 X |
| 2,821,315 | 1/1958 | Bucher | 414/477 |
| 3,097,755 | 7/1963 | Fulcher | 280/414.1 X |
| 3,380,607 | 4/1968 | Dale | 280/414.1 X |
| 3,753,355 | 8/1973 | Knoch . | |
| 3,826,391 | 7/1974 | Prince | 414/477 |
| 4,037,421 | 7/1977 | Whitley, Jr. . | |
| 4,470,746 | 9/1984 | Delachapelle | 414/477 X |
| 4,601,606 | 7/1986 | Eason | 405/1 |
| 4,626,162 | 12/1986 | Parisi | 280/414.1 X |

FOREIGN PATENT DOCUMENTS

| | | | |
|---|---|---|---|
| 7704480 | 10/1978 | Netherlands | 405/1 |

*Primary Examiner*—Dennis L. Taylor
*Attorney, Agent, or Firm*—Body, Vickers & Daniels

[57] ABSTRACT

A launching and lift assembly for small watercraft such as a jet ski comprises a skid cradle for seating the watercraft thereon for sliding movement off an end thereof. The skid cradle is mounted on a dock for rolling movement thereon forwardly over a launching edge thereof on a rear caster and on a pair of forward support rollers secured to the dock at its launching edge, for downward tilting of the skid cradle on the support rollers over the launching edge to cause the watercraft to slide downwardly off the tilted skid cradle and into the water when the skid cradle and seated watercraft are rolled forwardly on the dock to a position wherein their center of gravity is located forwardly of the support rollers.

18 Claims, 5 Drawing Sheets

WATERCRAFT LAUNCHING AND LIFT ASSEMBLY AND KIT THEREFOR

The present invention relates in general to a launching and lift assembly for small watercraft and to a kit for constructing such an assembly.

BACKGROUND OF THE INVENTION

Personal watercraft are small self-propelled boats that are used by one or two persons. One such type of personal watercraft are jet skis which are propelled by jets of water and are equipped with water pumps for propulsion. When not in use, it is desirable to store such jet skis out of the water and on a dock or cradle and not on a beach where the water pump and propeller could pickup debris.

Since jet skis are very heavy, ordinarily weighing somewhere between 230 to 450 pounds or so, some sort of lifting apparatus is needed to lift the jet ski out of the water and up onto a dock, and to lower the jet ski off the dock and into the water. Various prior art dock lifts have been employed heretofore to lift small boats and jet skis up out of the water but they have generally been unable to move the watercraft onto the dock and instead leave the watercraft positioned out over the water and not over the dock. This is disadvantageous because jet skis must be removed from the lift to be stored. However, because jet skis are inherently heavy in weight, they are difficult to move horizontally from a position on a lift cradle out over the water and onto the dock. Moreover, servicing the jet ski while it is located out over the water on prior art boat lifts is clumsy and difficult, requiring the servicing operator to lean out from the dock and over the water. Also, unlike large sized boats, jet skis are too small to climb on board for some types of servicing which is best performed when not on board the jet ski. Many of the prior art boat lifts, moreover have been of complicated and expensive construction some involving power driven lift and lowering means for the watercraft.

BRIEF SUMMARY OF THE INVENTION

The present invention contemplates new and improved launching and docking apparatus for small watercraft, such as jet skis, rowboats, and the like, which overcomes all of the above-referred to problems and others, and provides a launching and docking apparatus of simple construction and convenient to operate for mounting on a dock and which will position the docked watercraft over and onto the dock.

Briefly stated, in accordance with one aspect of the invention, a rest frame or skid cradle for a watercraft is supported on a dock for longitudinal sliding movement thereon at its forward end on a pair of support rollers rotatably mounted on the dock adjacent a launching edge thereof, with coincident axes of rotation extending approximately parallel to the dock launching edge, and at its rearward end by a caster depending from the skid cradle and in rolling engagement with the dock. The watercraft, when seated in the skid cradle, is slidable thereon off the forward end thereof so that when the skid cradle is longitudinally moved forwardly on the dock on the support rollers and caster a sufficient distance to locate the center of gravity of the seated watercraft and skid cradle forwardly of the support rollers, the skid cradle then tilts downwardly over the launching edge of the dock to permit the watercraft to slide down off the skid cradle and into the water to thereby launch the watercraft.

In accordance with another aspect of the invention, a preferably manually operative winch with a wind-on cable fastenable at its free end to the rearwardly pointed prow of the seated watercraft, is mounted on the rearward end of the skid cradle for either retarding the downward sliding movement of the watercraft off the downwardly tilted skid frame and into the water or pulling the watercraft out of the water back up onto the skid cradle and to a position thereon with its center of gravity located rearwardly of the support rollers to cause the tilted skid cradle to pivot thereon and return by gravity to its normal horizontal position on the dock.

In accordance with still another aspect of the invention, a safety chain is anchored at one end to the dock and at its other end to a rearward end portion of the skid cradle to limit the downward tilting of the skid cradle on the support rollers to an approximately 45° angle to the horizontal during launching and docking of the watercraft.

In accordance with a further aspect of the invention, the skid or rest cradle is comprised of parallel side rail or skid members for slidably supporting the watercraft in seated relation thereon for longitudinal sliding movement forwardly thereof and off the forward end of the skid cradle, and the side rail members have elongated rigid metal slide rails or tubes attached at their opposite ends to the undersides of the side rail members in spaced parallel relation thereto and in resting engagement with the support rollers for the skid cradle.

In accordance with a still further aspect of the invention, the support rollers are mounted in roller cage members attached to the dock and within which the metal slide rails of the skid cradle are confined for sliding engagement on the support rollers while permitting downward tilting of the slide rails within the roller cage members.

In accordance with another aspect of the invention, all the component parts for constructing a watercraft launching and lift assembly according to the invention except for the watercraft supporting cradle are providable in kit form for easy and convenient assembly by the purchaser of the kit.

The principal object of the invention is to provide a launching and lift assembly for small watercraft which is of simple an inexpensive construction comprised of a minimum number of component parts which can be easily and conveniently assembled into the final assembly on a launching dock.

Another object of the invention is to provide a launching and lift assembly for small watercraft which is mounted on a dock and which can be easily and conveniently operated by a single person.

Still another object of the invention is to provide a launching and lift assembly for small watercraft which is comprised of a minimum number of component parts the major portion of which can be supplied in kit form for easy and convenient assembly by the purchaser of the kit on a launching dock.

A further object of the invention is to provide a launching and lift assembly for small watercraft mounted on a dock and operable by the weight of the watercraft itself to launch the watercraft into the water.

A still further object of the invention is to provide a launching and lift assembly for small watercraft which is mounted on a dock and employs a skid cradle for the watercraft which is tiltable downwardly over the dock edge to permit the watercraft to slide down and off the tilted cradle into the water and pulling of the watercraft back up onto the tilted cradle.

Yet another object of the invention is to provide a launching and lift assembly for small watercraft which is comprised of a skid cradle for the watercraft which is supported for rolling movement on support rollers on the dock to a position in which the skid cradle and the watercraft seated thereon tilt downwardly of their own weight over the support rollers and over the dock edge to permit the watercraft to slide down off the skid cradle and into the water.

Another object of the invention is to provide a launching and lift assembly for small watercraft which is mounted on a dock and which employs a skid cradle for the watercraft which is tiltable downwardly over the dock edge to a limiting angle up to approximately 45° to the horizontal to permit the watercraft to slide down off the skid cradle and into the water.

Still another object of the invention is to provide a launching and lift assembly for small watercraft which is mounted on a dock and employs a skid cradle for the watercraft which is tiltable downwardly over the dock edge and provided with a winch cable to permit controlled downward sliding of the watercraft off the tilted lift cradle and pulling of the watercraft out of the water back up onto the tilted lift cradle.

Further objects and advantages of the invention will be apparent from the following detailed description of a preferred species thereof and from the accompanying drawings.

DESCRIPTION OF THE PREFERRED EMBODIMENT

Figure 1:
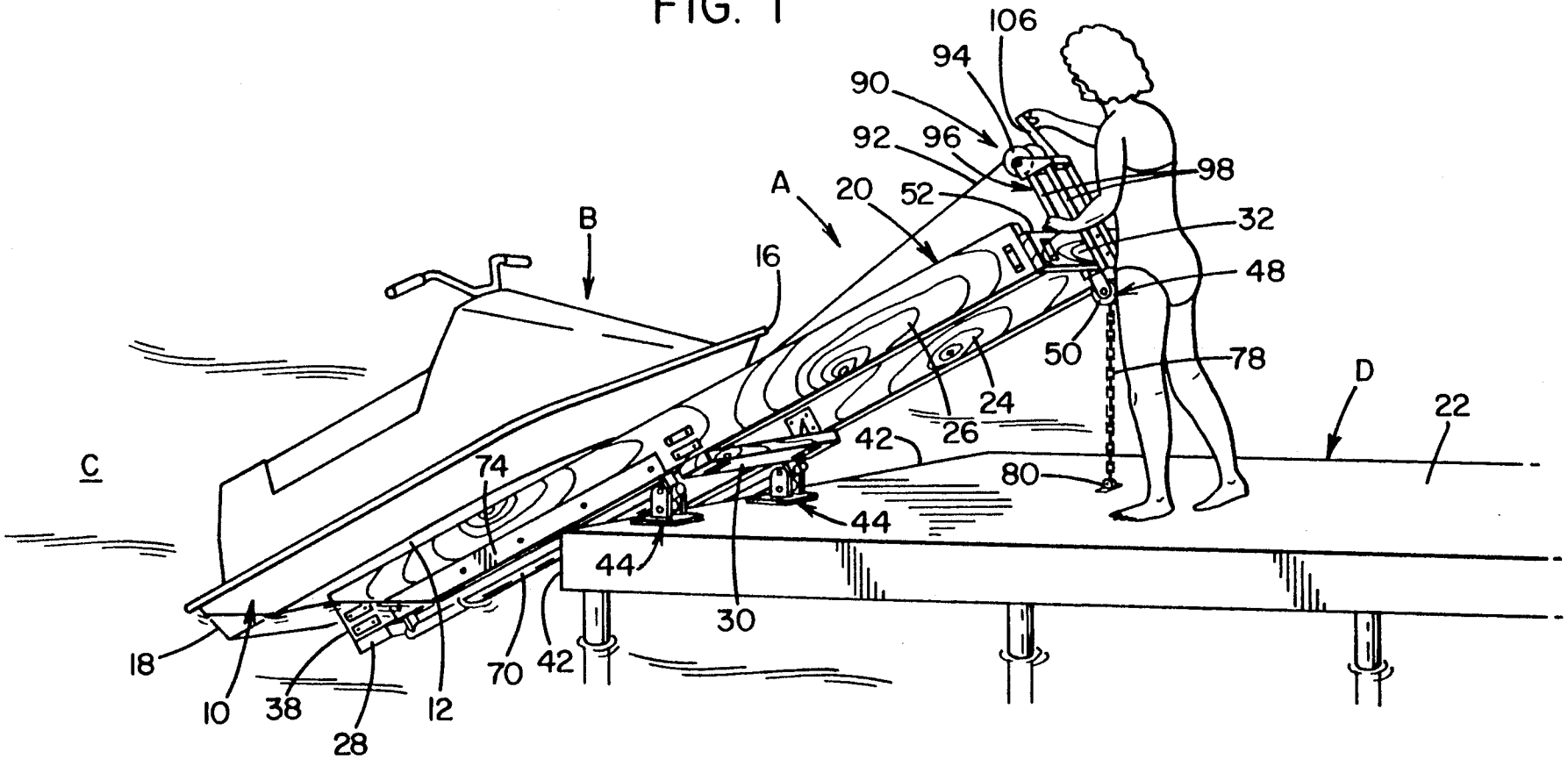
FIG. 1 is a perspective view of the launching and lift assembly comprising the invention shown in its operative position for either launching a watercraft from or lifting it out of the water onto a dock.
Figure 2:
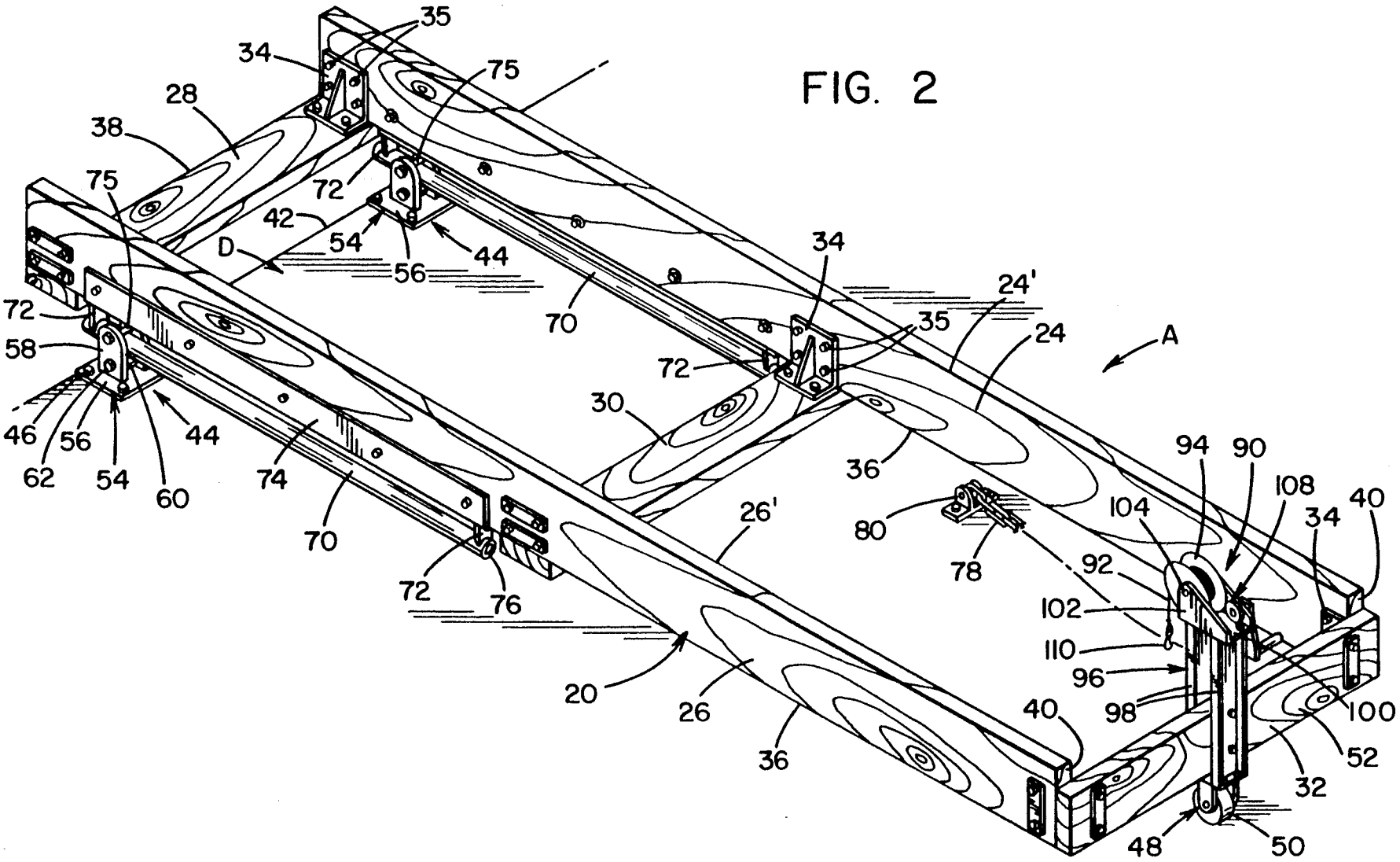
FIG. 2 is a perspective view of the launching and lift assembly of FIG. 1 shown in its inoperative or rest position on the dock.
Figure 3:
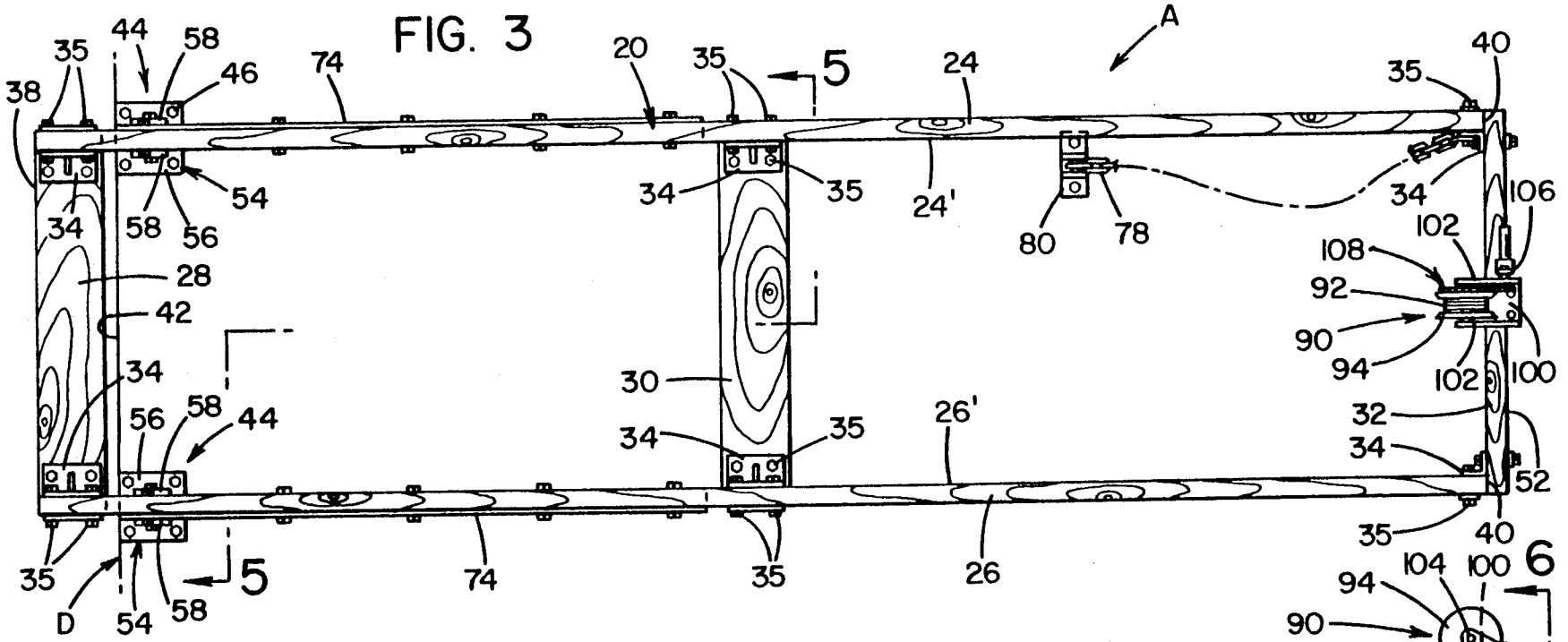
FIG. 3 is a plan view of the launching and lift assembly shown in FIGS. 1 and 2.

Referring now to the drawings wherein the showings are for the purpose of illustrating a preferred embodiment of the invention only and not for the purpose of limiting the same, the figures show a launching and lift assembly A for personal small watercraft B, such as a jet ski or small rowboat, for launching thereof from or lifting onto a dock D out of a body C of water. The watercraft B generally is comprised of a hull portion 10 (FIG. 5) formed with bottom surfaces 12, 14 which slope or curve upwardly at an angle from the longitudinal centerline L of the bottom of the hull 10. As shown in FIGS. 1 and 7A–7D, the hull 10 of the watercraft has a front or prow end 16 and a rear end 18.

Figure 5:
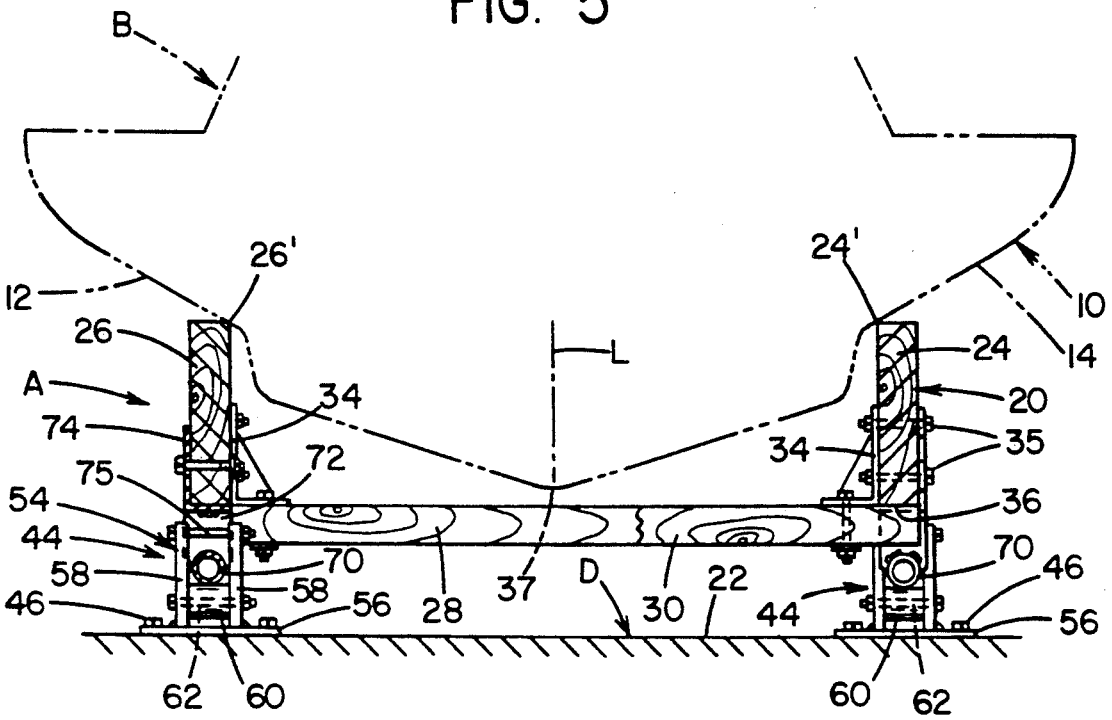
FIG. 5 is a transverse sectional view of the launching and lift assembly taken on the line 5—5 of FIG. 3.
Figure 6:
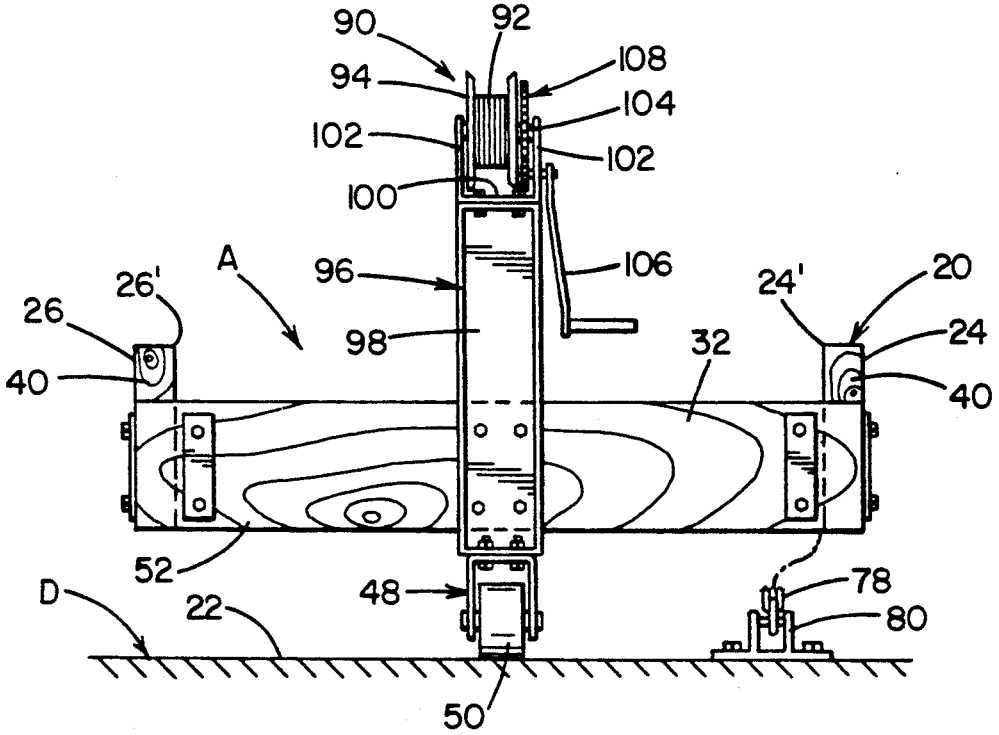
FIG. 6 is an end elevational view of the rearward end of the launching and lift assembly taken on the line 6—6 of FIG. 4; and, FIGS. 7A–7D are side elevational views of the launching and lift assembly comprising the invention showing the manner of operation thereof to lift a watercraft out of the water and into docked position on a dock.
Figure 7A:
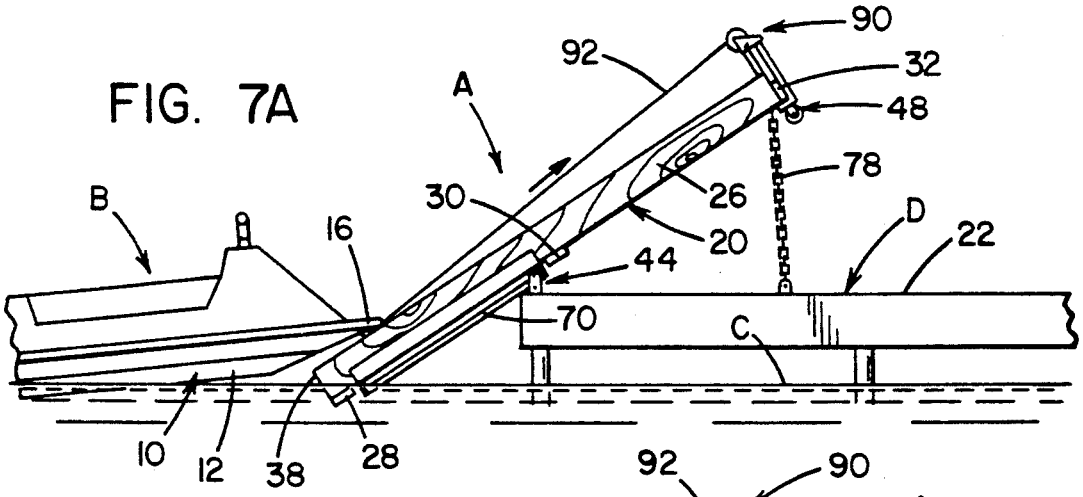
Figure 7B:
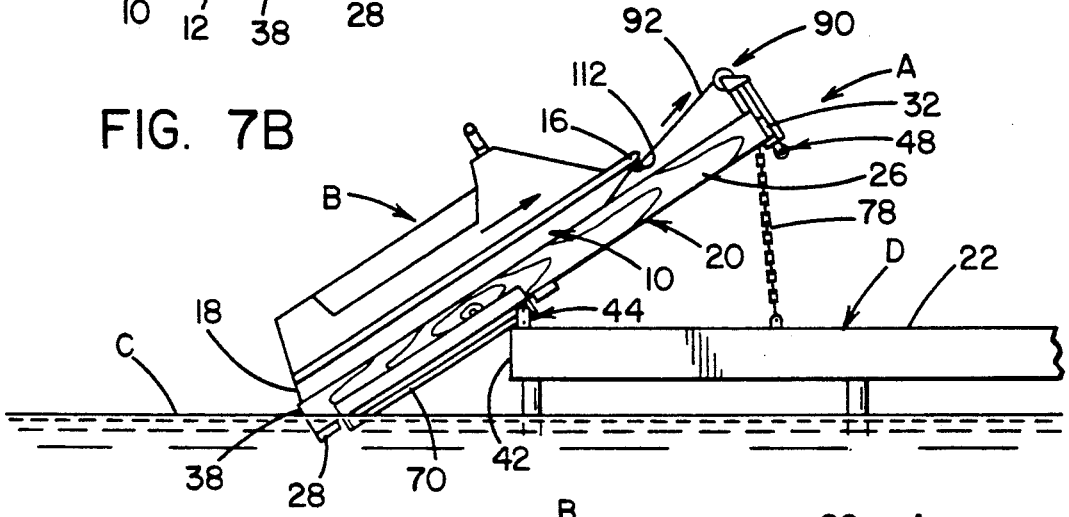
Figure 7C:
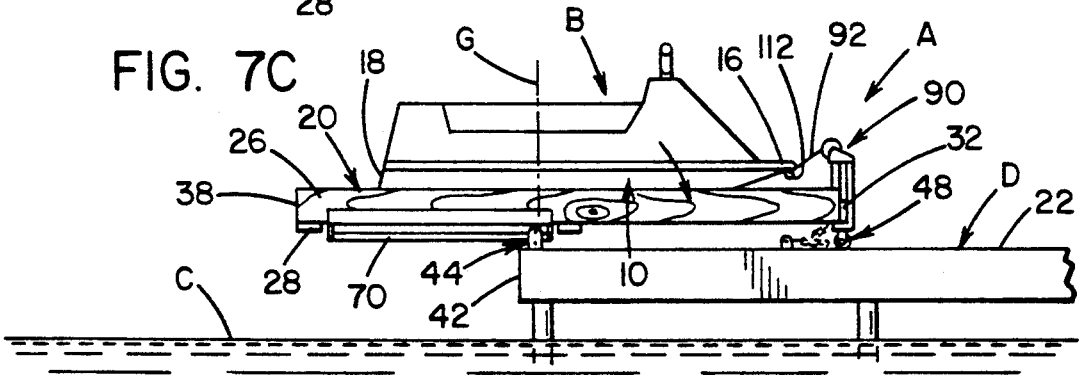
Figure 7D:
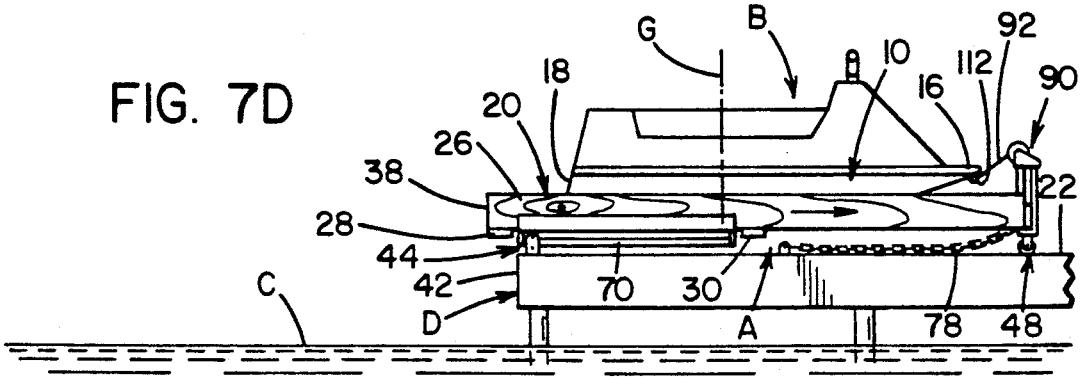

In accordance with the invention, the launching and lift assembly A comprises an elongated, generally rectangular shaped skid cradle or rest frame 20 for the watercraft B, which cradle is normally supported in a horizontal position on the top 22 of the dock D for seating the watercraft B thereon, as shown in FIGS. 5 and 7D. The skid cradle or rest frame 20 is comprised of a pair of elongated side rail members 24 and 26 connected together in spaced apart, parallel extending relation by front, intermediate, and rear cross members 28, 30 and 32, respectively, as by bolting the cross members to galvanized steel angle connector brackets 34 bolted by galvanized steel bolts 35 to the side rail members 24 and 26. When seated in launching position on the skid cradle 20, the watercraft B is positioned longitudinally of the skid cradle with the sloping bottom surfaces 14, 16 of the hull 10 resting on the top inside corner edges 24' and 26' of the two side rail members 24, 26 of the skid cradle, as shown in FIG. 5. The front and intermediate cross members 28 and 30 are bolted flatwise to the underside edges 36 of the side rail members 24, 26 of the skid cradle 20 in order to provide clearance for the center bottom or keel 37 of the hull 10 of the watercraft B when seated in place on the skid cradle and to permit the watercraft to slide longitudinally off the front end 38 of the skid cradle. The rear cross member 32 is bolted flatwise to the rear end extremities 40 of the side rail members 24, 26.

Preferably, all of the component parts of the launching and lift assembly A except for the side rail members 24, 26 and cross members 28, 30, 32 of the skid cradle 20 are supplied in kit form by the manufacturer. Because of the relatively large size of the side rail members 24, 26 which are around 11 feet in length and therefore unsuitable for supplying and shipping in kit form, the purchaser of the kit is left to supply for himself the side rail members 24, 26 and cross members 28, 30 and 32 forming the side cradle 20. To this end, the side rail members 24, 26 are preferably formed of wood planks or boards such as that commercially designated as 2"×8" boards having a length of around 11 feet, while the cross members 28, 30 and 32 are formed of 2"×6" boards having a length of around 25".

The elongated skid cradle or rest frame 20 is normally supported in a horizontal position on and spaced a slight distance above the horizontal top 22 of the dock D with its front end 38 located adjacent the launching edge 42 of the dock and the elongated cradle extending back perpendicularly therefrom. The skid cradle 20 is supported in such horizontal position on the dock D for longitudinal rolling movement thereon forwardly over the launching edge 42 of the dock and rearwardly back onto the dock, by a pair of roller cage stand assemblies 44 secured to the top 22 of the dock D at the launching edge 42 thereof as by fastening bolts 46 and supporting the skid cradle 20 at its front end 38, and by a roller caster 48 depending from and secured to the rear cross member 32 of the skid cradle 20 and provided with a roller 50 to support the rear end 52 of the skid cradle 20 for longitudinal rolling movement on the top 22 of the dock.

The roller cage stand assemblies 44 each comprise a roller support bracket 54 having a base plate 56 bolted flatwise to the top 22 of the dock D by the fastening bolts 46 and provided with a spaced pair of upstanding support arms 58 on and between which a stainless steel support roller 60 is rotatably mounted on a horizontal pivot pin 62 fastened to the support arms 58. The two roller cage stand assemblies 44 are mounted on the top 22 of the dock D at the launching edge 42 thereof with the axes of rotation of their support rollers 62 coincident and extending horizontal and parallel to the launching edge 42 of the dock.

The skid cradle or rest frame 20 is supported at its forward end portion on the support rollers 60 of the roller cage stand assemblies 44 for longitudinal rolling movement thereon by means of a pair of elongated slide rails 70 comprised of galvanized steel tubes which are fastened in slightly spaced parallel relation to the underside edges 36 of the side rail members 24, 26 of the skid cradle 20 by galvanized steel spacer members 72 welded to the slide rails 70 and to galvanized steel angle irons 74 fitted against the underside edges 36 of and bolted to the side rail members 24, 26 of the skid cradle 20. The slide rails 70 are confined within the roller cage assemblies 44 to prevent their accidental disengagement therefrom by horizontally extending locking pins 75 fastened to the support arms 58 of the respective roller support brackets 54 in a position overlying and spaced slightly from the slide rails 70 resting on the support rollers 60, the spacing of the locking pins 75 above the slide rails 70 being sufficient to permit the side rails 70 to tilt upwardly in the roller cage stand assemblies 44 to an angle of at least 45° to the horizontal.

Figure 4:
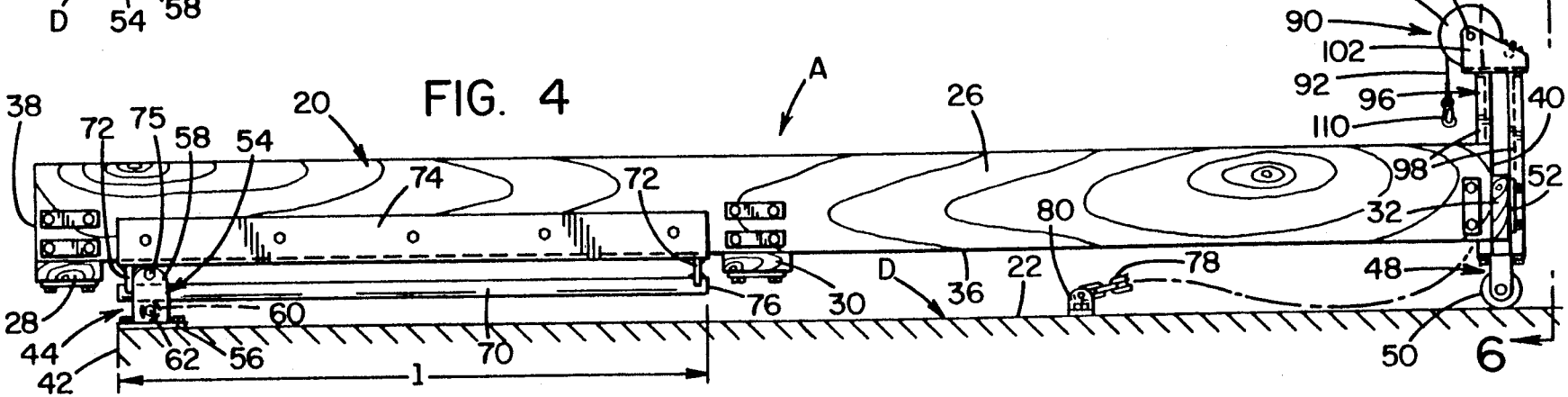
FIG. 4 is a side elevational view of the launching and lift assembly of FIGS. 1 and 2.

The slide rails 70 extend rearwardly along the forward portion of the skid cradle 20 from the front cross member 28 thereof an appreciable length 1 (FIG. 4) to locate their rearward ends 76 closely adjacent the intermediate cross member 30 of the skid cradle 20 which is located approximately medially of the length thereof. The length l of the slide rails 70 is sufficient to permit the center of gravity G (FIG. 7D) of the combined skid cradle 20 and watercraft B, when properly seated on the side rail members 24, 26, to be shifted to a position forwardly of the support rollers 60, by forward longitudinal rolling movement of the skid cradle 20 and seated watercraft B on the support rollers 60 and center roller 50, to thereby cause the skid cradle 20 and seated watercraft B to tilt or tip downwardly of their own weight over the launching edge 42 of the dock D to a sufficient launching angle up to approximately 45° to the horizontal, as shown in FIGS. 1 and 7B, to permit the watercraft B to slide down off the downwardly tilted skid cradle 20 and into the body C of water, thereby launching the watercraft. A safety chain 78 is connected at one end to a chain retainer bracket 80 bolted or otherwise anchored to the top 22 of the dock D and connected at its other end to the rear end 52 of the skid cradle 20 as by one of the fastening bolts 35 to prevent over tilting of the skid cradle 20 and limit the downward tilting thereof to an angle of approximately 45° to the horizontal.

A preferably manually operable winch 90 with a cable 92 wound onto a rotatable drum 94 is mounted in upstanding relation on the rear cross member 32 of the skid cradle 20 for connection of the free end of the cable 92 to the prow end 16 of the watercraft B to control and restrain the rate of downward sliding movement thereof backwardly off the downwardly tilted skid frame 20 into the body C of water during the watercraft launching operation, and to pull the watercraft back up onto the downwardly tilted skid frame 20 a sufficient distance to cause the skid frame to pivot on the support rollers 60 of the roller cage assemblies 44 back to its horizontal position on the dock during the watercraft docking operation.

The winch drum 94 is rotatably mounted for rotation about a horizontal axis perpendicular to the side rail members 24, 26 of the skid cradle 20 on the top end of a stand assembly 96 comprised of a pair of channel-shaped support legs 98 of galvanized steel bolted to opposite sides of the rear cross member 32 of the skid cradle 20 and extending upwardly therefrom in spaced parallel relation. As shown, the roller caster 48 is bolted to the bottom end of the stand assembly 96. A U-shaped drum mounting bracket 100 of galvanized steel having a spaced pair of upstanding support arms 102 is welded to the upper ends of the upstanding support legs 98 and is provided with a pivot shaft 104 extending horizontally between and journaled in the support arms 102 and on which the drum 94 is fastened to rotatably mount it on the mounting bracket 100. The winch drum 94 is rotated by a hand operated crankarm 106 rotatably mounted on the bracket 100 and driving the pivot shaft 104 and the winch drum 94 through an intermeshing pair 108 of spur-gears. The free end of the winch cable 92 is provided with a suitable clasp or hook 110 for attaching the cable to the prow end 16 of the watercraft B seated on the skid cradle 20, such as to an eye bolt or other fastener 112 (FIGS. 7B–7D) secured to the prow end 16 of the watercraft.

To launch the watercraft B by the assembly A, the skid cradle 20 is positioned on the dock D by rolling it rearwardly thereon to its rearwardmost position as shown in FIG. 7D. The watercraft B is then seated in proper position on the side rail members 24, 26 of the skid cradle 20 with its prow end 16 facing rearwardly (FIG. 7D), and the free or clasp end 110 of the winch cable 92 then connected to the eye bolt 112 secured to the adjacent prow end 16 of the watercraft. The skid cradle 20 is then rolled forwardly on the dock D, by the person operating the assembly A, until the center of gravity G of the watercraft and skid cradle is located forwardly of the cradle support rollers 60 of the roller cage stand assemblies 44, i.e., to the left of the roller cage stand assemblies 44 in FIG. 7C, whereupon the skid cradle 20 and the seated watercraft B will then tilt downwardly over the launching edge 42 of the dock, as shown in FIG. 7B, to cause the watercraft B to slide down off the downwardly tilted skid cradle 20 and into the body C of water. During the downward tilting of the skid cradle 20, the operator maintains the necessary degree of tension in the winch cable 92, by means of the winch crankarm 106, to control and restrain the rate of downward sliding movement of the watercraft B off the downwardly tilted skid cradle 20 to a safe launching speed.

To dock a water borne watercraft B, the skid cradle 20 is rolled forwardly on the dock D to it forwardmost position on the support rollers 60 of the roller cage stand assemblies 44 to cause it to tilt downwardly over the launching edge 42 of the dock D to its limiting tilted position as determined by the safety chain 78, as shown in FIG. 7A. The water borne watercraft B is then maneuvered into longitudinal alignment with the lowered front end 38 of the skid cradle 20 and the winch cable 92 connected at its free clasp end 110 to the eye bolt 112 on the prow end 16 of the watercraft. The winch 90 is then operated by the operator manually turning the crankarm 106 thereof, to winch and lift the watercraft B up onto the downwardly tilted skid cradle 20, as indicated by the arrows in FIG. 7B, into a rearward position thereon in which the center of gravity G of the watercraft and skid cradle is located rearwardly of the support rollers 60 of the roller cage stand assemblies 44, as shown in FIG. 7C, to cause the skid cradle and seated watercraft to tilt back down to a horizontal position on the dock D, whereupon the skid cradle and seated watercraft are rolled rearwardly on the dock D to their limiting rearward or docked position thereon, as shown in FIG. 7D.

From the above description, it will be evident that the invention provides a launching and lift assembly B for small watercraft that is of simple and inexpensive construction comprised of a minimum number of component parts which can be easily and conveniently assembled into the final assembly on a launching dock. The launching and lift assembly can be easily and conveniently operated by a single person and is operable by the weight o the watercraft itself to launch it into the water.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

Having thus described the invention, it is claimed:

1. A launch and lift assembly for small watercraft adapted for mounting on a dock with a launching edge overlying a body of water, said assembly comprising an elongated approximately rectangular skid cradle having a pair of parallel side rail members spaced apart for engaging and slidably supporting the hull of said watercraft in a stable seated relation thereon for longitudinal sliding movement forwardly thereof and off the forward end of said skid cradle, support means normally supporting said skid cradle in a horizontal position on said dock for longitudinal rolling movement thereon, said support means comprising a depending caster mounted on the rearward end of said skid cradle for rolling engagement with the dock and a pair of support rollers rotatably mounted in spaced apart relation on the dock adjacent said launching edge and supporting the forward end portions of said side rail members for longitudinal sliding movement thereon, said support rollers having coincident axes of rotation extending approximately parallel to said launching edge of said dock, said skid cradle being rollable longitudinally forward on said dock on said support caster and said support rollers a sufficient distance to locate the center of gravity of the skid cradle and seated watercraft at a point forwardly of said support rollers to thereby cause the forward end of the skid cradle to tilt downwardly over said launching edge of the dock to a sufficient angle to cause the watercraft to slide forwardly of and down off the forward end of the tilted skid cradle by its own weight to effect launching of the watercraft.

2. A launch and lift assembly as defined in claim 1, wherein a winch with a wind-on cable having fastening means at its free end for attachment to the prow of the watercraft either when seated in launching position on said skid cradle or when floating is mounted on the rearward end of said skid cradle for either retarding the rate of downward sliding movement of the watercraft off the downwardly tilted skid cradle during launching or for pulling the watercraft out of the water back up onto the tilted skid cradle during docking and to a position thereon with its center of gravity located rearwardly of said support rollers to cause the tilted skid cradle to pivot on said support rollers and return by gravity to its normal horizontal position on the dock.

3. A launch and lift assembly as defined in claim 2, wherein said winch is manually operative.

4. A launch and lift assembly as defined in claim 1, wherein a safety chain is anchored at one end to said dock and at its other end to a rearward end portion of said skid cradle to limit downwardly tilting of the skid cradle on said support rollers to an approximately 45° angle to the horizontal during launching and docking.

5. A launch and lift assembly as defined in claim 2, wherein said skid cradle includes a rear cross member extending between and secured at its ends to the said cradle side rail members at rearward ends thereof, and said winch is mounted in upstanding relation on the said rear cross member.

6. A launch and lift assembly as defined in claim 5, wherein said caster is mounted in depending relation on the said rear cross member of said skid cradle.

7. A launch and lift assembly as defined in claim 1, wherein said cradle side rail members are comprised of wood planks and are connected together at their front and rear ends by front and rear cross members comprised of wood boards and at their middle region by a medial cross member comprised of a wood board.

8. A launch and lift assembly for small watercraft adapted for mounting on a dock with a launching edge overlying a body of water, said assembly comprising an elongated approximately rectangular skid cradle having a pair of parallel side rail members spaced apart for engaging and slidably supporting the hull of said watercraft in a stable seated relation thereon for longitudinal sliding movement forwardly thereof and off the forward end of said skid cradle, support means normally supporting said skid cradle in a horizontal position on said dock for longitudinal rolling movement thereon, said support means comprising a depending caster mounted on the rearward end of said skid cradle for rolling engagement with the dock and a pair of roller cage stand assemblies anchored to the dock adjacent said launching edge and in spaced apart relation thereon and provided with respective support rollers supporting the forward end of said skid cradle on said dock for rolling movement thereon, said support rollers having coincident axes of rotation extending approximately parallel to said launching edge of said dock, and a pair of slide rails mounted on said cradle side rail members and extending longitudinally thereof in parallel relation and engaged and confined in said roller cage assemblies in resting engagement with said support rollers thereof for longitudinal sliding movement thereon, said slide rails extending rearwardly of said skid cradle from the said forward end thereof to a point rearwardly beyond the center of gravity of said watercraft, when seated in launching position on said skid cradle, to permit tilting of said slide rails and associated forward end of the skid cradle on said support rollers downwardly over said launching edge of the dock to a sufficient angle, when the skid cradle is rolled longitudinally forward on said caster and support rollers a sufficient distance to locate said center of gravity of the seated watercraft at a point forwardly of said support rollers, to cause the watercraft to slide forwardly of and down off the forward end of the tilted skid cradle by its own weight to effect launching of the watercraft.

9. A launch and lift assembly as defined in claim 8, wherein a winch with a wind-on cable having fastening means at its free end for attachment to the prow of the watercraft either when seated in launching position on said skid cradle or when floating is mounted on the rearward end of said skid cradle for either retarding the rate of downward sliding movement of the watercraft off the downwardly tilted skid cradle during launching or for pulling the watercraft out of the water back up onto the tilted skid cradle during docking and to a position thereon with its center of gravity located rearwardly of said support rollers to cause the tilted skid cradle to pivot on said support rollers and return by gravity to its normal horizontal position on the dock.

10. A launch and lift assembly as defined in claim 9, wherein said winch is manually operative.

11. A launch and lift assembly as defined in claim 8, wherein a safety chain is anchored at one end to said dock and at its other end to a rearward end portion of said skid cradle to limit downwardly tilting of the skid cradle on said support rollers to an approximately 45° angle to the horizontal during launching and docking.

12. A launch and lift assembly as defined in claim 8, wherein said slide rails comprise elongated rigid metal tubes attached at their opposite ends to the undersides of said cradle side rail members to position said tubes therebelow in spaced parallel relation thereto.

13. A launch and lift assembly as defined in claim 9, wherein said skid cradle includes a rear cross member extending between and secured at its ends to said cradle side rail members at the rearward ends thereof, and said winch is mounted in upstanding relation on said rear cross member.

14. A launch and lift assembly as defined in claim 13, wherein said caster is mounted in depending relation on said rear cross member of said skid cradle.

15. A launch and lift assembly as defined in claim 8, wherein said cradle side rail members are comprised of wood planks and are connected together at their front and rear ends by front and rear cross members comprised of wood boards and at their middle region by a medial cross member comprised of a wood board.

16. A launch and lift assembly as defined in claim 15, wherein said slide rails comprise elongated rigid metal tubes attached at their opposite ends to the underside of said wood plank side rail members to position said tubes therebelow in spaced parallel relation thereto.

17. A launch and lift assembly as defined in claim 8, wherein said roller cage stand assemblies are each provided with a horizontal locking pin extending transversely of and spaced above the respective said slide rails to confine said slide rails within said roller cage stand assemblies while permitting said tilting movement of said slide rails therewithin.

18. A launch and lift assembly as defined in claim 16, wherein said metal tube side rails are attached at their opposite ends in spaced relation to said wood plank side rail member by metal brackets welded to said metal tube side rails and to respective elongated metal angle irons bolted to the underside of said wood plank side rail members.

* * * * *